US005586816A

United States Patent [19]

Geiss, II

[11] Patent Number: 5,586,816

[45] Date of Patent: Dec. 24, 1996

[54] MULTI-PURPOSE, MOBILE STORAGE CABINET WITH HORIZONTALLY AND VERTICALLY ADJUSTABLE SHELF STRUCTURE

[76] Inventor: Michael J. Geiss, II, 531 Oak St., Syracuse, N.Y. 13203

[21] Appl. No.: 492,240

[22] Filed: Jun. 19, 1995

Related U.S. Application Data

[63] Continuation-in-part of Ser. No. 119,485, Sep. 13, 1993, abandoned, and Ser. No. 911,090, Jul. 9, 1992, abandoned.

[51] Int. Cl.[6] ..... A47B 83/00

[52] U.S. Cl. ..... 312/301; 312/310

[58] Field of Search ..... 312/298, 301, 312/303, 310, 235.3, 249.9

[56] References Cited

U.S. PATENT DOCUMENTS

| | | | |
|---|---|---|---|
| 140,324 | 6/1873 | Vetter | 312/235.3 |
| 187,429 | 2/1877 | Sykes | 312/235.3 |
| 2,859,083 | 11/1958 | Devlin et al. | 312/303 |
| 4,893,885 | 1/1990 | Borello | 312/249.9 |

*Primary Examiner*—Peter M. Cuomo
*Assistant Examiner*—Gerald A. Anderson
*Attorney, Agent, or Firm*—Charles S. McGuire

[57] ABSTRACT

A mobile storage cabinet in combination with a shelf structure horizontally and vertically adjustable with respect to the cabinet. In a first embodiment, the shelf structure comprises an inner cabinet having vertically spaced shelves slidingly mounted therein. In the stored position, the inner cabinet including shelves rests inside the outer cabinet beneath the top surface thereof; in the extended position, the inner cabinet rests forwardly of the outer cabinet and may be further moved vertically between fully lowered and raised positions. In a second embodiment, a unitary shelf is horizontally and vertically adjustable with respect to the cabinet, this embodiment being especially useful as a work table while the first embodiment is especially useful for transporting and storing equipment.

27 Claims, 7 Drawing Sheets

MULTI-PURPOSE, MOBILE STORAGE CABINET WITH HORIZONTALLY AND VERTICALLY ADJUSTABLE SHELF STRUCTURE

REFERENCE TO RELATED APPLICATION

This application is a continuation-in-part of my application Ser. No. 07/911,090, filed Jul. 9, 1992, now abandoned, and application Ser. No. 08/119,485, filed Sep. 13, 1993, now abandoned.

BACKGROUND OF THE INVENTION

This invention relates to equipment structures and, more particularly, to a novel and unique storage cabinet which is compact and mobile and further includes an inner cabinet shelf structure which may be adjusted in both horizontal and vertical directions with respect to the outer cabinet.

The present invention is primarily intended to provide a mobile storage cabinet to house and carry various equipment from site to site in an unencumbered and easy manner. For example, society has gained a heightened awareness of the importance of providing medical services to those upon which it would pose a hardship to travel from their home to the doctor or other caregiver. As a result, a need has developed for means by which caregivers can transport their equipment to the patient.

Development of such mobile equipment cabinets may especially be seen in the area of dentistry and ophthalmology where the dentist/ophthalmologist must transport an array of typically bulky and awkward, specialized examination/treatment equipment to the patient who may be bedridden or otherwise disabled. Examples of mobile cabinets designed for medical use may be seen in the following patents:

U.S. Pat. No. 4,160,323 issued to Tracy on Jul. 10, 1979. The Tracy patent discloses a portable dental cabinet on casters.

U.S. Pat. No. 3,969,006 issued to Brown on Jul. 13, 1976. The Brown patent discloses a medical emergency treatment cabinet which stores a variety of medications, supplies and equipment for on-the-spot treatment of a patient requiring immediate medical attention.

U.S. Pat. No. 4,095,859 issued to Decker et al on Jun. 10, 1978. The Decker et al patent discloses a portable eye examination system cart having an instrument console and storage areas for ophthalmic drugs and examination supplies, small instrument accessories, spare lamps and parts, etc.

SUMMARY OF THE INVENTION

The present invention concerns itself not only with providing a mobile cabinet for transporting medical equipment, but also with providing a mobile cabinet which can be used for a large variety of other purposes as will be explained more fully below.

It is therefore a principle object of the present invention to provide a multi-purpose, mobile storage cabinet.

It is another object to provide a mobile storage cabinet for transporting bulky and relatively heavy medical equipment such as ophthalmic examination/treatment equipment.

It is a further object to provide a mobile cabinet unit which includes a shelf structure which is horizontally and vertically adjustable with respect to the outer cabinet.

It is yet a further object to provide a combined mobile cabinet and shelf structure which is easily maneuverable through hallways, around corners and cramped spaces.

It is still a further object to provide a mobile cabinet and shelf structure having the above attributes which is also easy to handle and operate.

It is still another object to provide a mobile cabinet and shelf structure in which a unitary shelf structure is provided to be used as a horizontally and vertically adjustable work table.

Other objects will in part be obvious and in part appear hereinafter.

In accordance with the foregoing objects, the invention comprises a mobile storage cabinet including a pull-out shelf structure which may be adjusted in both horizontal and vertical directions with respect to the outer cabinet structure. In a first embodiment of the invention, two vertically spaced shelves are slidingly mounted within an inner cabinet structure which may be moved between a "stored" position beneath the top surface of the outer cabinet, and an "extended" position spaced forwardly of the outer cabinet. When in the extended position, the inner cabinet structure may be further moved between fully lowered and fully raised positions with respect to the outer cabinet. This embodiment is especially useful for storing and transporting equipment. The number, size and arrangement of the shelves may of course be varied to fit the particular needs of the user.

In a second embodiment, a single rectangular shelf is provided which is horizontally and vertically adjustable when extended from and with respect to the outer cabinet, and upon which various items may be placed for vertical lifting. In this embodiment, the pullout shelf is especially useful as a work table which may be vertically adjusted to a variety of working heights as needed.

In both embodiments, a linking, extensible slider assembly interconnects the outer cabinet structure with the shelf structure (which includes the inner cabinet in the first embodiment) whereby the shelf structure may be manually moved between the stored position within the outer cabinet structure and the extended position forwardly spaced from and adjacent to the outer cabinet structure. Electric actuator and controls are provided to selectively move the shelf structure in a vertical direction with respect to and higher than the top surface of the outer cabinet structure when in the extended position.

DETAILED DESCRIPTION

Figure 1:
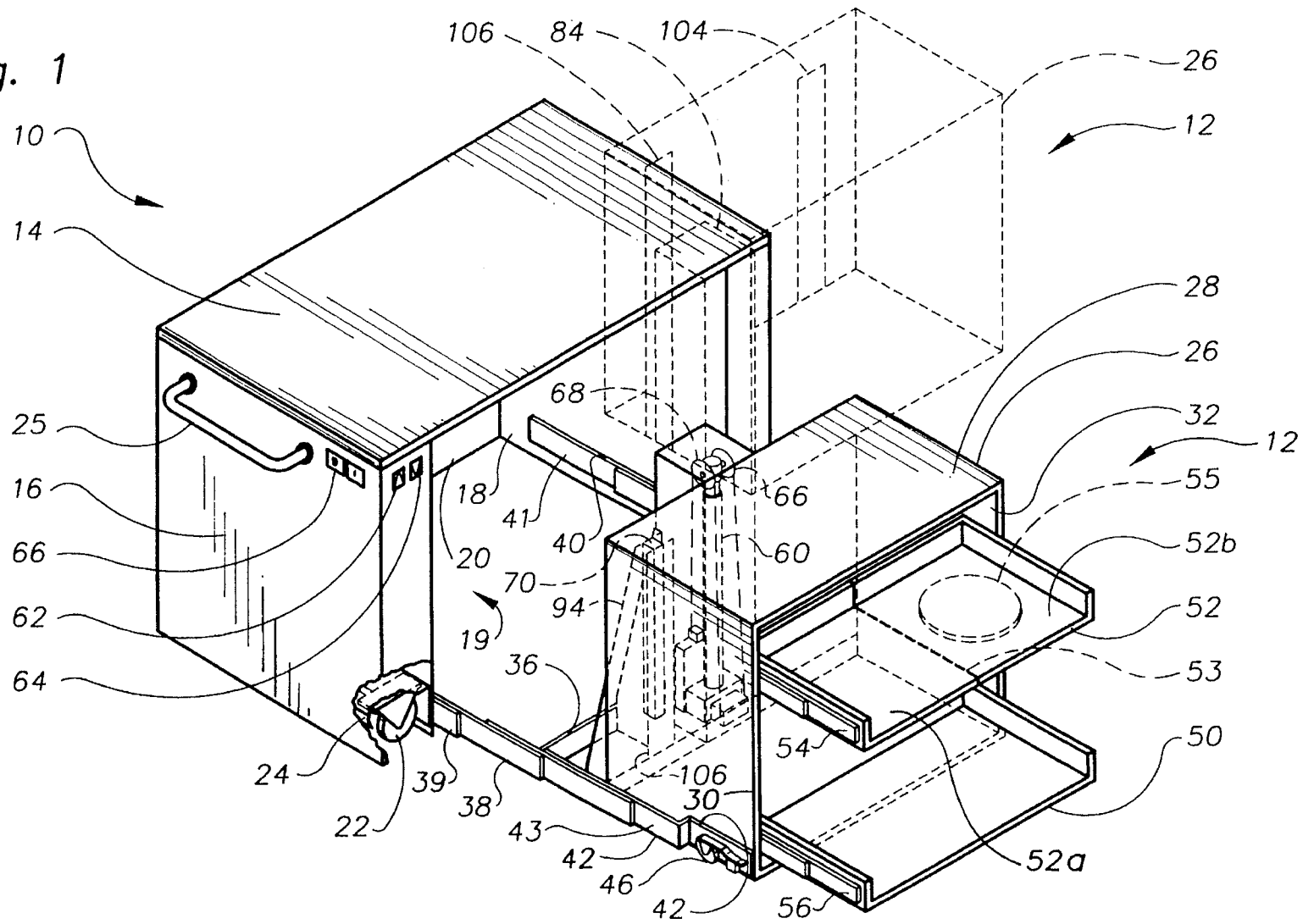
FIG. 1 is a front, perspective view of a first embodiment of the invention showing the inner cabinet and shelf structure in the extended position spaced from the outer cabinet structure in both the fully lowered (solid lines) and fully raised (dotted lines) positions. Portions of the electric lifting mechanism are also shown in dotted outline.

Referring now to the drawings, there is seen in FIG. 1 a first embodiment of the invention generally comprising an outer cabinet structure 10 and an inner cabinet and shelf structure 12 connected thereto. Outer cabinet structure 10 is of rectangular configuration having a top planar surface 14, opposite side walls 16 and 18 and back wall 20 extending downwardly from the perimeter thereof to define an open front 19. Side walls 16 and 18 are hollow and a set of four casters 22 are disposed therein at the four corners of cabinet 10 by mounting brackets anchored to the inside surfaces of walls 16 and 18. One such caster 22 is revealed in FIG. 1 mounted to bracket 24. The two casters 22 disposed at either corner of wall 16 are of the swivel type making cabinet 10 easily maneuverable around corners. In this regard, a handle 25 is mounted to wall 16 to pull or push cabinet 10 about.

Reference is now made to the inner cabinet and shelf structure 12 which is seen to comprise a second rectangular cabinet 26 having a top 28, opposite side walls 30 and 32 and back wall 34. Cabinet 26 is mounted upon a rectangular platen 36 having an upwardly turned perimeter along the back and side edges thereof. Inner cabinet 26 may be vertically lifted from platen 36 when in the extended position seen in FIG. 1 in the manner to be described.

Two linking, extensible slider assemblies 38 and 40 of the track and roller type interconnect outer cabinet 10 to platen 36, assemblies 38 and 40 attaching to the bottom, inner surfaces of side walls 16 and 18 at first ends 39 and 41 thereof, respectively, and to the outer surfaces of opposite sides 42 and 44 of platen 36 at the second ends 43 and 45 thereof, respectively.

Figure 3:
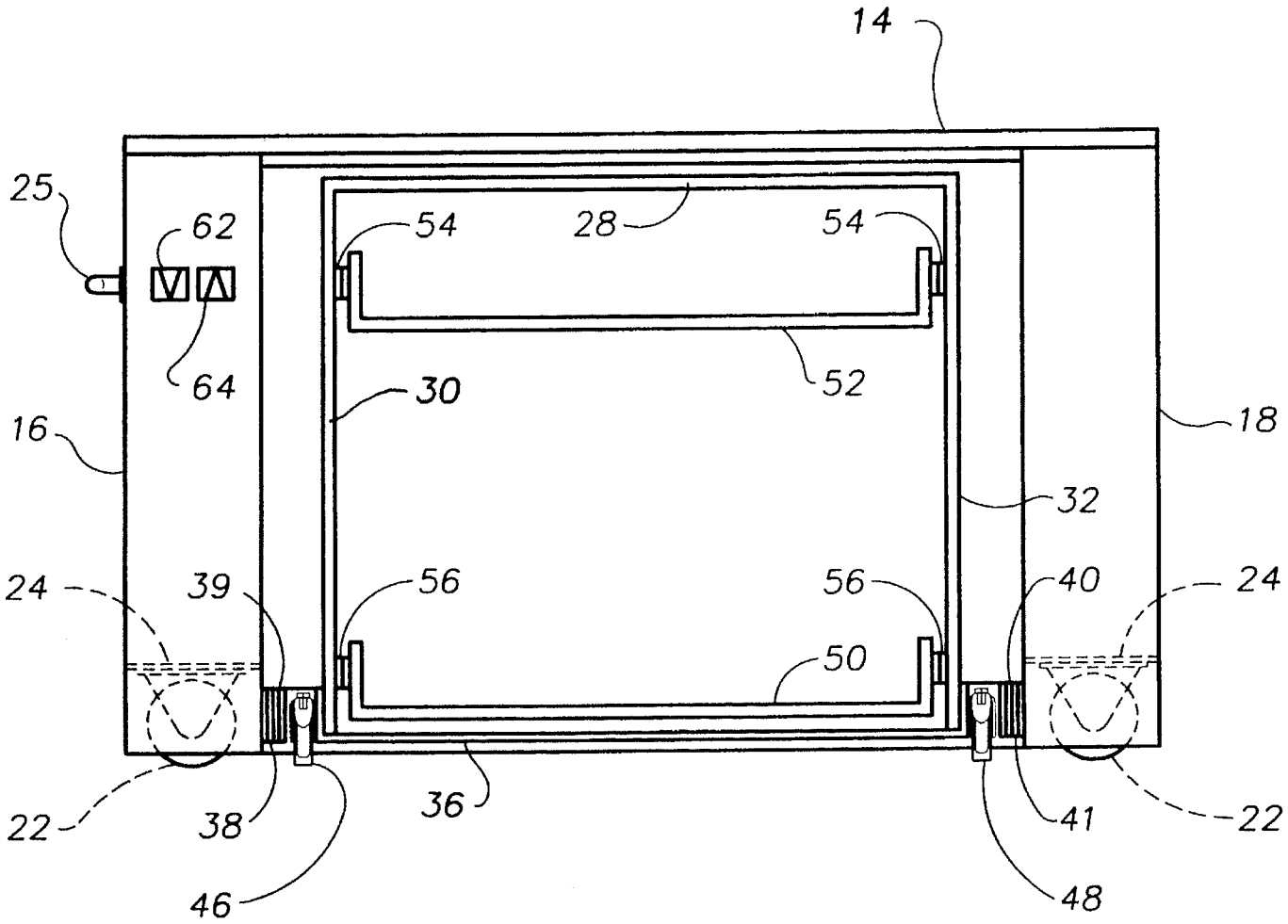
FIG. 3 is a front, elevational view of the first embodiment of the invention seen in FIGS. 1 and 2. The inner cabinet and shelf structure are shown in the stored position within the outer cabinet structure.

A pair of casters 46 and 48 are provided at the forward ends of platen sides 42 and 44 whereby the slider assemblies 38 and 40 in combination with casters 46 and 48 permit the shelf structure 12 (comprising platen 36, cabinet 26 and the slide-out shelves and lifting mechanism described below) to be moved between the "extended" position seen in FIGS. 1 and 4 and the "stored" position seen in FIG. 3. When moved to the extended position, shelf structure 12 is positioned forward of outer cabinet 10 with sufficient clearance to be lifted vertically with respect thereto. When moved to the stored position as seen in FIG. 3, the entire shelf structure 12 fits within outer cabinet 10 beneath top 14 and between sides 16 and 18.

In the embodiment of FIG. 1, a pair of vertically spaced shelves 50 and 52 are slidingly mounted within the second, inner cabinet 26 by linking, extensible slider assemblies 54 and 56 located on either side of both shelves 50 and 52, respectively. A dashed line 53 is provided to indicate that shelf 52 could alternatively be two laterally adjacent shelves **52*a* and 52*b* which could be extended independently of each other if desired. Circular dashed line 55 indicates an optional circular platform rotatably mounted upon shelf 52*b*. These two features (laterally adjacent shelves and rotatable platform) may prove useful in certain situations. For example, a doctor or other care-giver may place examination equipment upon platform 55 and extend shelf 52*b* outwardly to facilitate examination of a patient, with the patient seated at one side of shelf 52*b* and the doctor at the other side. In this respect, it is intended that the number, size and arrangement of shelves within cabinet 26** be varied to accommodate the particular needs and purposes of the user, some examples of which will follow.

Figure 2:
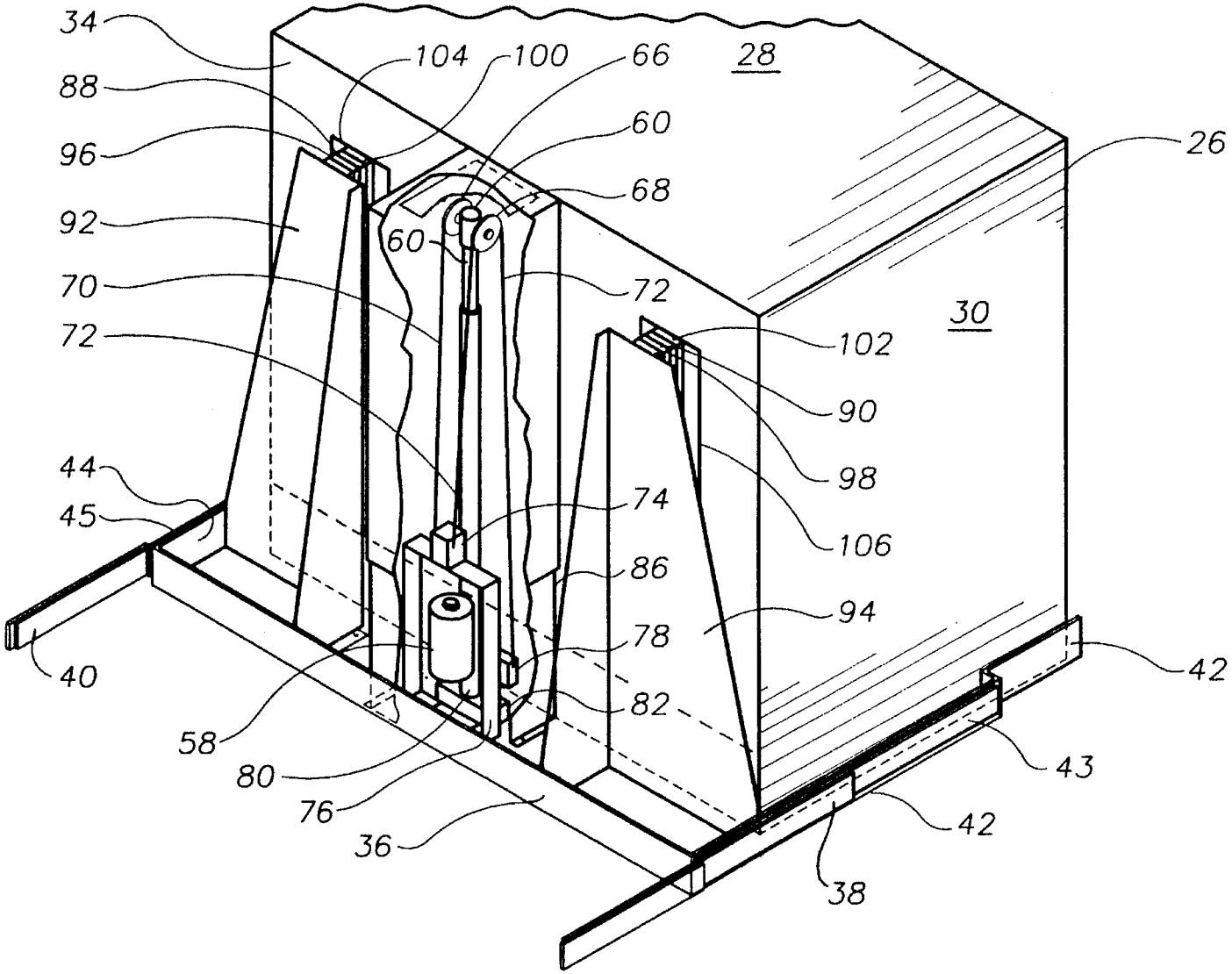
FIG. 2 is a rear, perspective view of the inner cabinet and shelf structure seen in FIG. 1 with a portion thereof being partly broken away to reveal the electric lifting mechanism.
Figure 2A:
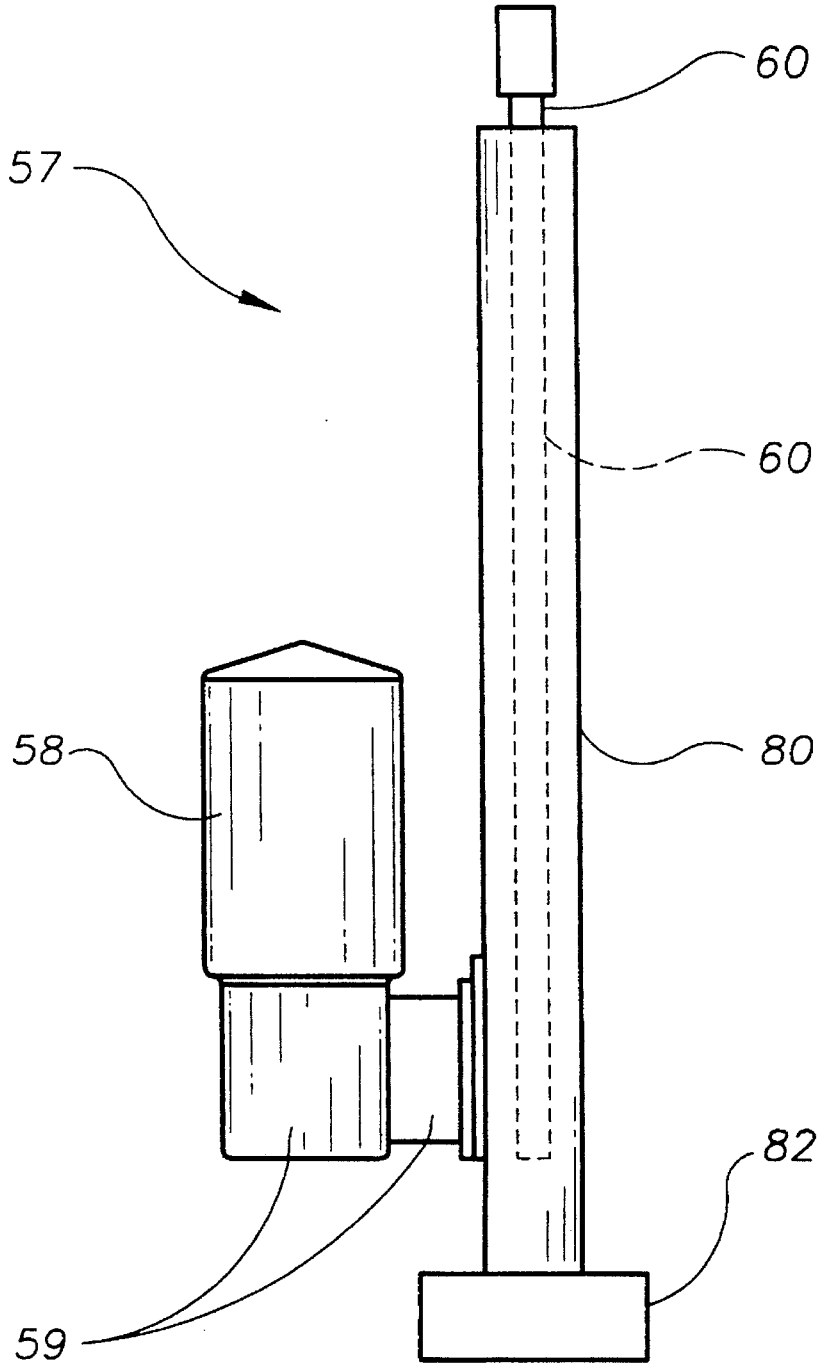
FIG. 2*a* is an elevational view of the electric lifting mechanism seen in FIG. 2.

Referring now to the vertical lifting mechanism denoted generally by the reference numeral 57, attention is turned to FIGS. 2 and **2*a* which show a rear perspective of the second, inner cabinet 26 having shelves 50 and 52, and the vertical lifting mechanism 57, respectively. The lifting mechanism 57 (also known as a "linear actuator" in the art) is a purchased part which may be purchased through Raco Int'l., Inc. of Bethel, Pa. by model no. LA 30S. Generally speaking, actuator 57 comprises a shaft 60 which telescopes within a cylinder 80, and a motor 58 which attaches to cylinder 80 through a gear box 59 which houses worm and bevel gears (not shown) which interconnect and transmit the rotational movement of motor 58 to the vertical movement of shaft 60 within cylinder 80. Electric motor 58 is thus operable to move shaft 60 vertically up and down as desired via electric switches 62 and 64, respectively, located on the front panel of leg 16 (FIG. 1). A power switch 66 is also provided as is an electric cord (not shown) which may plug into a 120V AC outlet to supply electricity to motor 58**.

It is seen that a pair of sprocket gears 66 and 68 are rotatably mounted to opposite sides of the top end of shaft 60 and include chains 70 and 72 trained thereover, respectively. First ends of chains 70 and 72 attach to either side of a block 74 which anchors to platen 36 via bracket 76. The second, opposite ends of chains 70 and 72 attach to either side of a second block 78 which is fixedly mounted to back wall 34 of cabinet 26. As mentioned, shaft 60 telescopes within cylinder 80 which is fixedly mounted to a lower block 82 with block 82 being fixedly mounted to platen 36. An upper housing 84 surrounds and protects the upper portions of the linear actuator 57 and is attached to the top of and moves with shaft 60. A separate, lower housing 86 is secured only to platen 36 and surrounds and protects the lower portions of the linear actuator 57.

Located on either side of the lifting mechanism are extensible, linking slider assemblies 88 and 90 which interconnect and permit vertical movement of cabinet 26 with respect to platen 36 as follows. A pair of upstanding walls 92 and 94 of L-shaped cross-section are anchored to the top surface of platen 36. The linking slider assemblies 88 and 90 each have first outer slider members 96 and 98, respectively, which fixedly mount directly to walls 92 and 94, respectively. The opposite, outer slider members 100 and 102 fixedly mount to panels 104 and 106 which in turn are fixedly mounted to back wall 34 of cabinet 26.

Figure 4:
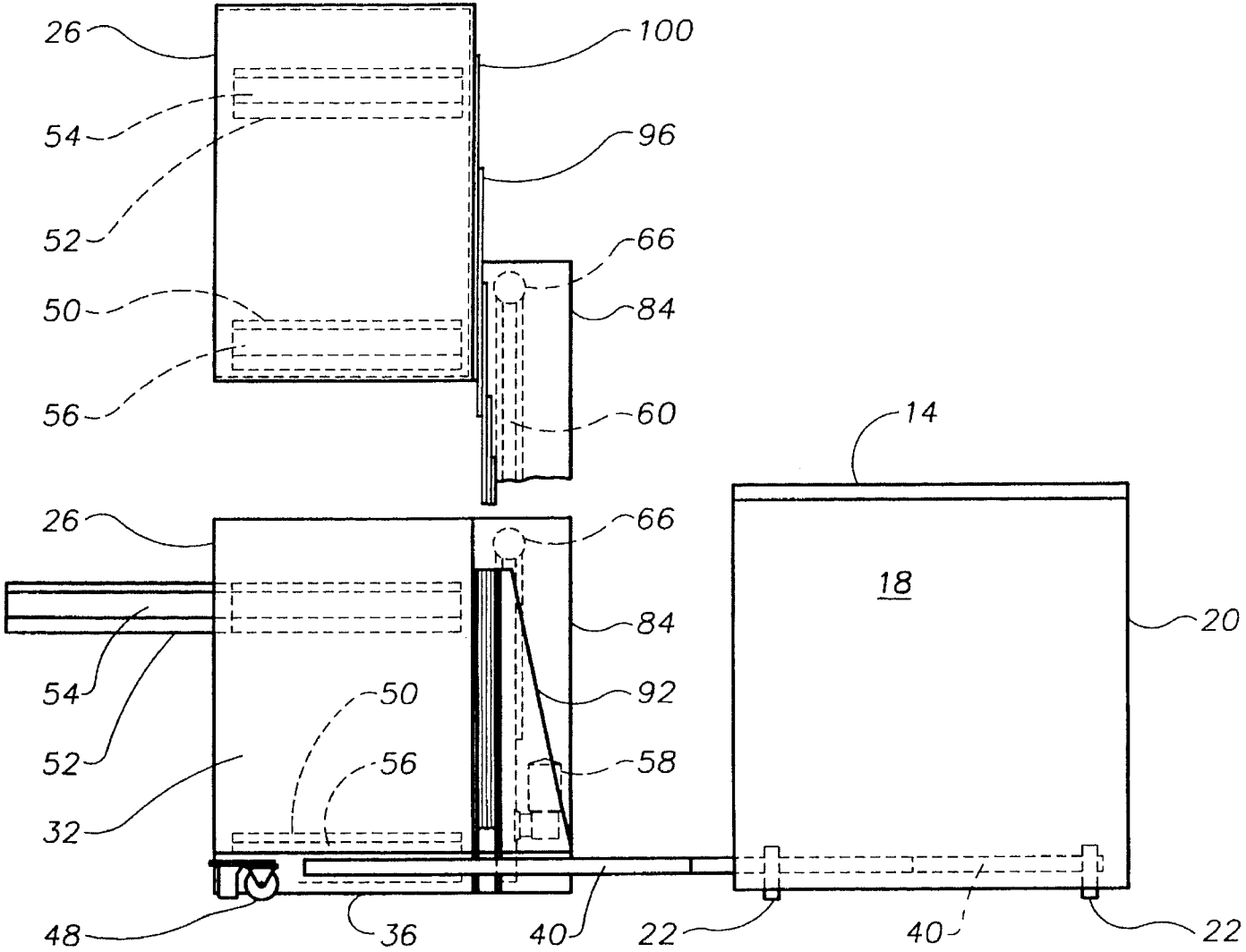
FIG. 4 is a side, elevational view of FIG. 1 showing the inner cabinet fully extended from the outer cabinet. The fully raised position of the inner cabinet and shelf structure is also shown in spaced relation above the fully lowered position.

To effect vertical movement of cabinet 26 from the fully lowered position seen in FIG. 2 to the fully raised position seen in dotted outline in FIGS. 1 and 4, switch 62 is pushed which turns motor 58 in a first direction. It is of course obvious that the shelf structure 12 must be in the fully extended position spaced from outer cabinet 10 before lifting. Activation of motor 58 in the first direction raises shaft 60 which carries sprocket gears 66 and 68 thereon as previously described. Since first ends of chains 70 and 72 are attached to block 74 which remains fixed to platen 36, and the second ends of chains 70 and 72 attach to block 78 which remains fixed to cabinet 26, as shaft 60 rises, sprocket gears 66 and 68 ride along chains 70 and 72 causing the block 78 and thus cabinet 26 to rise vertically with shaft 60. Upper housing 84 also rises vertically therewith while lower housing 86 remains attached to platen 36 as do walls 92 and 94.

Referring to FIG. 4, linking slider assemblies 96 and 98 are seen in their fully extended position with cabinet 26 thus in the fully raised position (upper), and also in their fully collapsed position with cabinet 26 in the fully lowered position (lower). Shelves 50 and 52 may slide in and out of cabinet 26 as desired, whether or not cabinet 26 is in the fully raised, fully lowered or stored position (FIG. 3).

Figure 5:
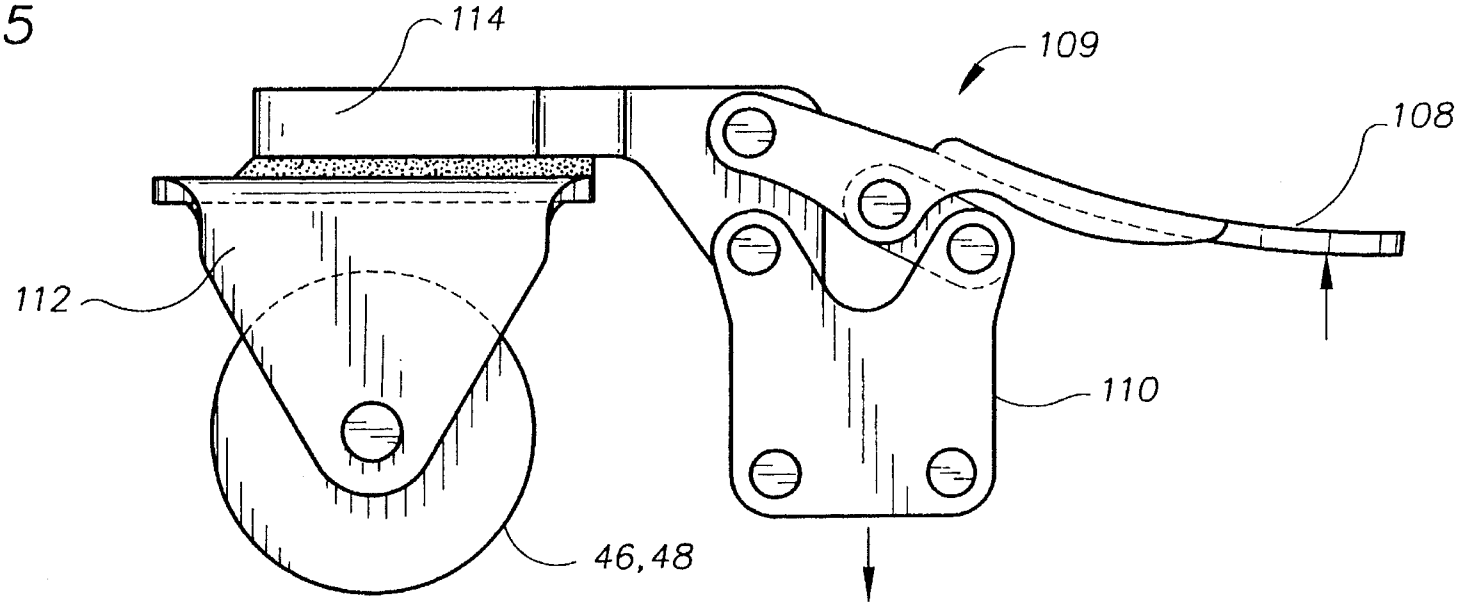
FIG. 5 is a side, elevational view of the caster and caster lifting mechanism seen attached to the bottom of the inner cabinet structure in FIGS. 1, 3, 4 and 7.
Figure 6:
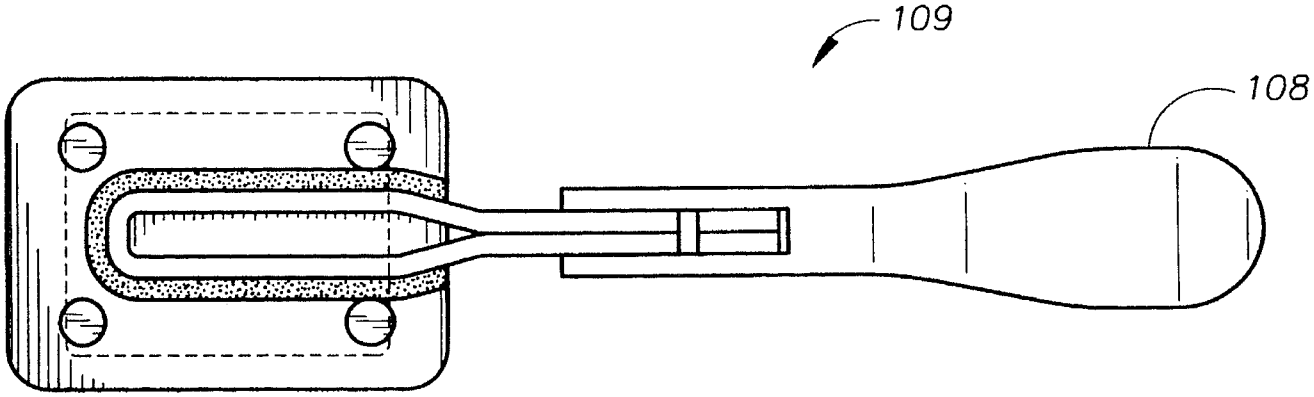
FIG. 6 is a top plan view of FIG. 5.

When cabinet 26 is in the extended position spaced from outer cabinet 10, casters 46 and 48 may be lifted from the floor by a lift clamp 109 as seen in FIGS. 5 and 6 by pulling lever 108 upwardly which moves block 110 downwardly to engage the floor while simultaneously lifting caster yoke 112 with member 114. This securely rests platen 36 upon the floor during vertical movement of inner cabinet 26.

The first embodiment of the invention just described is intended primarily for storing and transporting a variety of items from site to site. During transportation-of cabinet 10, inner cabinet 26 including shelves 50 and 52 are in their stored position within cabinet 10 as seen in FIG. 3. When in use, inner cabinet 26 is moved to the extended position (FIG. 1) upon casters 46 and 48 and may be adjusted vertically as desired via switches 62 and 64. The possible uses envisioned for the embodiment of FIG. 1 are many. For example, this embodiment is intended to be used by medical personnel to transport medical equipment from site to site when treating patients who cannot travel to the medical office. Reference is hereby made to co-pending patent application Ser. No. 888,146 of the above-named inventor which discloses a mobile combination desk and wheelchair lift intended primarily for ophthalmically treating wheelchair-bound patients who roll their wheelchair upon the rotatable platform for vertical lifting. The first embodiment of the present invention may be used to transport the needed ophthalmic equipment to the patient along with the desk and wheelchair lift of Ser. No. 888,146.

Other uses may include using the invention in a library, for example, where books may be stored on shelves 50 and 52, or in an automobile repair shop for storing tools. In all instances of use, the feature of horizontal and vertical adjustability of cabinet 26 and shelves 50 and 52 is very useful for people in a wide variety of settings. For instance, since shelves 50 and 52 may be vertically lifted to the working height of a person whether that person be standing, sitting, or lying down, the need for constant bending and reaching is substantially eliminated thereby easing the strain on the individual. This may be an auto mechanic with a "bad back" or a wheelchair-seated person in a library, these being but only two examples of use of the first embodiment of the invention.

Figure 7:
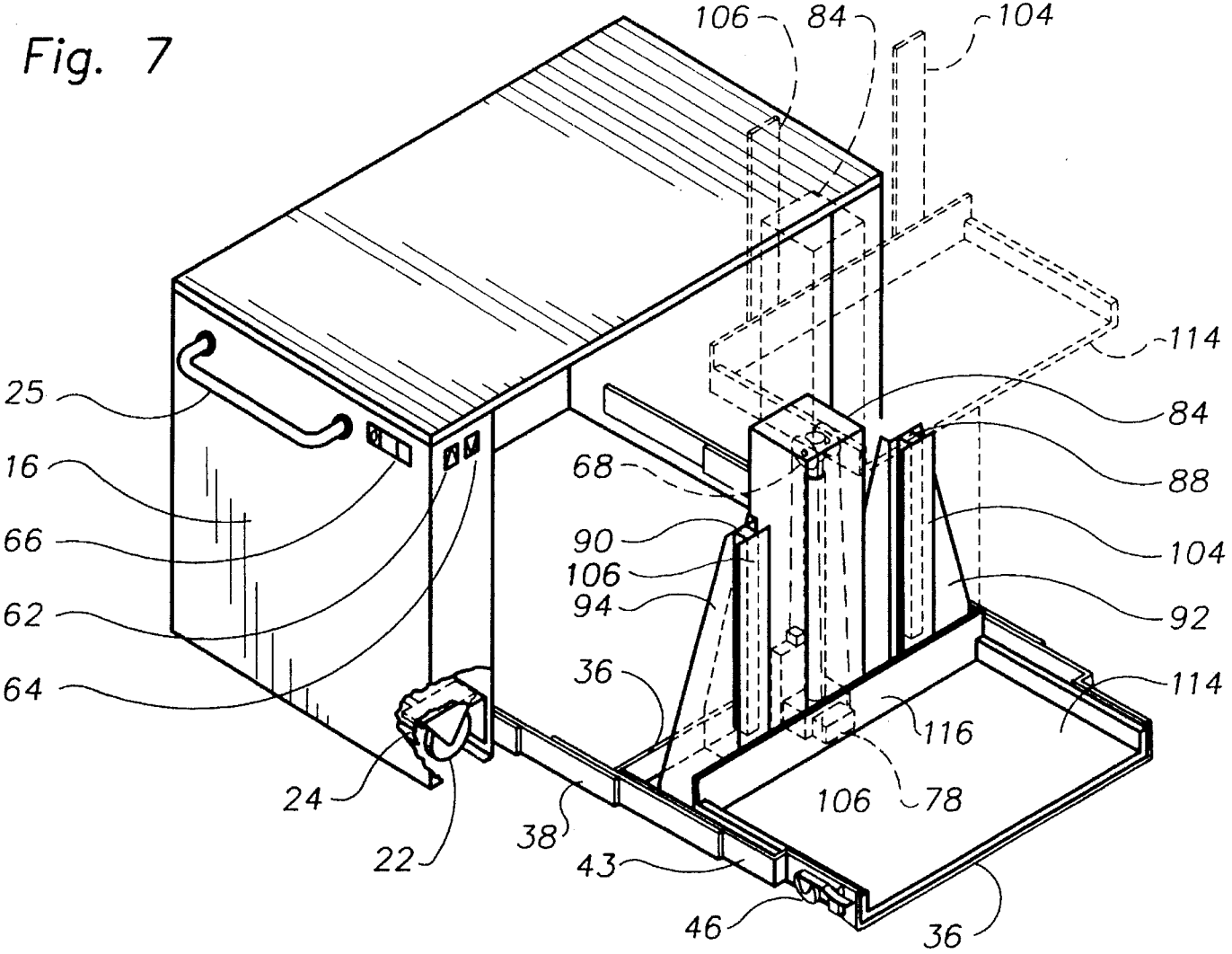
FIG. 7 is a front, perspective view of a second embodiment of the invention showing a unitary shelf (or work table) in the extended position spaced from the outer cabinet in both the fully lowered (solid lines) and fully raised (dotted lines) positions. Most portions of the electric lifting mechanism are also shown in dotted outline.

Referring now to a second embodiment of the invention, attention is turned to FIG. 7 which shows only a single shelf 114 mounted upon platen 36. Block 78 and panels 104 and 106 are fixedly mounted to rear flange 116 of shelf 114 which thereby moves between the fully lowered (solid lines) and fully raised (dotted lines) positions upon activation of motor 58 via switches 64 and 62, respectively. In this embodiment of the invention, shelf 114 is useful as a vertically adjustable work table, also with many possible uses. Several examples include an animal examination/treatment table for veterinarians; a computer work table; a patient table for hospitals and MASH units; and a cadaver work table for funeral homes and morgues. When shelf 114 is used to lift particularly heavy items, the electric vertical lifting mechanism disclosed herein may be substituted with an appropriate hydraulic mechanism capable of lifting heavy loads.

There is thus provided two embodiments of a mobile storage cabinet with horizontally and vertically adjustable shelf structure. While the first embodiment is especially useful for storing and transporting necessary items and equipment, the second embodiment is especially useful as a work table. It will be apparent to those skilled in the art that various modifications and changes may be made to the invention without departing from the full spirit and scope thereof as defined by the claims which follow.

What is claimed is:

1. A combination cabinet and shelf structure comprising:

a) an outer cabinet having a top, planar surface and at least one support leg extending therefrom adapted to position and support said top surface a predetermined distance above a substantially planar floor surface;

b) a shelf structure comprising:

i) a platen;

ii) an inner cabinet of generally rectangular configuration having a top, bottom and opposite side walls extending between said top and bottom walls to define an open front, said bottom wall mounted in covering relation to said platen; and iii) at least one shelf slidably mounted to said inner cabinet within said open front between said side walls, said shelf being slidingly movable between a stored position beneath said top wall in said open front, and an extended position spaced forwardly of and adjacent said open front, said shelf lying in a plane spaced and parallel to said top and bottom walls;

c) horizontal adjusting means connected to and between said outer cabinet and said platen, said horizontal adjusting means operable to horizontally move said platen and said inner cabinet between a stored position with said platen and inner cabinet positioned beneath said outer cabinet top surface, and an extended position with said platen and inner cabinet positioned forwardly of and adjacent to said outer cabinet; and d) vertical adjusting means connected to and between said platen and said inner cabinet, said vertical adjusting means operable to vertically move said inner cabinet and said at least one shelf between a fully lowered position with said inner cabinet bottom wall lying in covering relation to said platen, and a fully raised position with said inner cabinet bottom wall positioned a predetermined distance above said platen.

2. The combination cabinet and shelf structure according to claim 1 wherein said vertical adjusting means comprises:

a) a hollow cylinder having first and second ends and a shaft telescopically positioned therein, said cylinder mounted to said platen at said first end thereof and said shaft telescoping within and extending from said second, opposite end thereof;

b) at least one sprocket gear rotatably mounted to the end of said shaft opposite the end which is telescopically inserted into said cylinder second end;

c) at least one chain having first and second ends trained over said at least one sprocket gear, said chain first end being anchored to said inner cabinet and said chain second end being anchored to said platen; and d) means selectively telescopically moving said shaft within said cylinder between fully lowered and fully raised positions, whereby moving said shaft from said fully lowered position to said fully raised positions simultaneously moves said inner cabinet from said fully lowered to said fully raised positions, respectively, with said at least one chain riding over said at least one sprocket gear.

3. The combination cabinet and shelf structure according to claim 2 wherein said means selectively telescopically moving said shaft within said cylinder comprises an electric motor.

4. The combination cabinet and shelf structure according to claim 3 wherein said vertical adjusting means further comprises a first linking, extensible slider assembly having a first outer slider member and a second outer slider member positioned opposite and lying in a spaced, parallel plane to said first outer slider member, said first and second outer slider members movable in opposite directions of each other along said spaced, parallel planes between a fully collapsed position wherein said first outer slider member lies laterally spaced to said second outer slider member, and a fully extended position wherein said first outer slider member lies longitudinally spaced to said second outer slider member, said first outer slider member being attached to said platen and said second outer slider member being attached to said inner cabinet, whereby movement of said shaft and said inner cabinet between said fully lowered and fully raised position is simultaneous with said movement of said linking, extensible slider assembly between said fully collapsed and fully extended positions, respectively.

5. The combination cabinet and shelf structure according to claim 4 wherein said vertical adjusting means further comprises a wall of L-shaped cross-section vertically mounted to said platen, said first outer slider member being attached to said wall.

6. The combination cabinet and shelf structure according to claim 5 wherein said cylinder and said shaft are positioned substantially at the center and adjacent to said inner cabinet back wall and wherein a second linking, extensible slider assembly is provided, said first linking, extensible slider assembly positioned on one side of said cylinder and said shaft and said second linking, extensible slider assembly positioned on the side of said cylinder and shaft opposite said one side.

7. The combination cabinet and shelf structure according to claim 6 and further comprising first and second housings, said first housing surrounding and attached to said shaft, said second housing attached to said platen and surrounding said electric motor and said cylinder.

8. The combination cabinet and shelf structure according to claim 7 wherein said horizontal adjusting means comprises third and fourth linking, extensible slider assemblies with said first outer slider members of said third and fourth assemblies mounted to said outer cabinet and said second outer slider members of said third and fourth assemblies mounted to said platen, whereby movement of said third and fourth assemblies between said collapsed and said extended positions is simultaneous with said movement of said inner cabinet between said stored and extended positions, respectively.

9. The combination cabinet and shelf structure according to claim 8 wherein said outer cabinet further comprises two laterally spaced, hollow support legs with said top surface extending therebetween, and further comprising a plurality of casters attached to said legs operable to roll said outer cabinet including said inner cabinet over a substantially planar surface.

10. The combination cabinet and shelf structure according to claim 9 and further comprising first and second liftable casters attached to said platen and contacting said planar surface, said liftable casters including a lever pivotally connected to a block whereby moving said lever in a first direction operates to lift said liftable caster from said planar surface while simultaneously lowering said block to engage said planar surface, and whereby moving said lever in a second direction opposite said first direction operates to lift said block from said planar surface while simultaneously lowering said liftable caster to engage said planar surface.

11. The combination cabinet and shelf structure according to claim 10 wherein said vertical adjusting means further comprises a switch mounted to one of said legs and connected to said electric motor, said switch operable to selectively operate said motor between said first and second directions.

12. The combination cabinet and shelf structure according to claim 1 wherein said at least one shelf is divided into two laterally adjacent sections independently slidingly movable between said stored and extended positions.

13. The combination cabinet and shelf structure according to claim 12 and further including a circular platform rotatably mounted upon one of said adjacent sections.

14. A combination cabinet and shelf structure comprising:

a) an outer cabinet having a top, planar surface and at least one support leg extending therefrom adapted to position and support said top surface a predetermined distance above a substantially planar floor surface;

b) a shelf structure comprising:

i) a platen; and ii) a shelf mounted in superposed relation to said platen;

c) horizontal adjusting means connected to and between said outer cabinet and said platen, said horizontal adjusting means operable to horizontally move said platen including said shelf between a stored position with said platen and said shelf positioned beneath said outer cabinet top surface, and an extended position with said platen and said shelf positioned forwardly of and adjacent to said outer cabinet; and d) vertical adjusting means connected to and between said platen and said shelf, said vertical adjusting means operable to vertically move said shelf between a fully lowered position with said shelf lying in covering relation to said platen, and a fully raised position with said shelf positioned a predetermined distance above said platen, said shelf remaining in a plane parallel to said platen and said outer cabinet top surface, said vertical adjusting means comprising:

i) a hollow cylinder having first and second ends and a shaft telescopically positioned therein, said cylinder mounted to said platen at said first end thereof and said shaft telescoping within and extending from said second, opposite end thereof;

ii) at least one sprocket gear rotatably mounted to the end of said shaft opposite the end which is telescopically inserted into said cylinder second end;

iii) at least one chain having first and second ends trained over said at least one sprocket gear, said chain first end being anchored to said shelf and said chain second end being anchored to said platen; and iv) means selectively telescopically moving said shaft within said cylinder between fully lowered and fully raised positions, whereby moving said shaft from said fully lowered position to said fully raised positions simultaneously moves said shelf from said fully lowered to said fully raised positions, respectively, with said at least one chain riding over said at least one sprocket gear.

15. The combination cabinet and shelf structure according to claim 14 wherein said means selectively telescopically moving said shaft within said cylinder comprises an electric motor.

16. The combination cabinet and shelf structure according to claim 15 wherein said vertical adjusting means further comprises a first linking, extensible slider assembly having a first outer slider member and a second outer slider member positioned opposite and lying in a spaced, parallel plane to said first outer slider member, said first and second outer slider members movable in opposite directions of each other along said spaced, parallel planes between a fully collapsed position wherein said first outer slider member lies laterally spaced to said second outer slider member, and a fully extended position wherein said first outer slider member lies longitudinally spaced to said second outer slider member, said first outer slider member being attached to said platen and said second outer slider member being attached to said shelf, whereby movement of said shaft and said shelf between said fully lowered and fully raised position is simultaneous with said movement of said linking, extensible slider assembly between said fully collapsed and fully extended positions, respectively.

17. The combination cabinet and shelf structure according to claim 16 wherein said vertical adjusting means further comprises a wall of L-shaped cross-section vertically mounted to said platen, said first outer slider member being attached to said wall.

18. The combination cabinet and shelf structure according to claim 17 wherein said cylinder and said shaft are positioned substantially at the center and adjacent to said shelf back wall and wherein a second linking, extensible slider assembly is provided, said first linking, extensible slider assembly positioned on one side of said cylinder and said shaft and said second linking, extensible slider assembly positioned on the side of said cylinder and shaft opposite said one side.

19. The combination cabinet and shelf structure according to claim 18 and further comprising first and second housings, said first housing surrounding and attached to said shaft, said second housing attached to said platen and surrounding said electric motor and said cylinder.

20. The combination cabinet and shelf structure according to claim 19 wherein said horizontal adjusting means comprises third and fourth linking, extensible slider assemblies with said first outer slider members of said third and fourth assemblies mounted to said outer cabinet and said second outer slider members of said third and fourth assemblies mounted to said platen, whereby movement of said third and fourth assemblies between said collapsed and said extended positions is simultaneous with said movement of said shelf between said stored and extended positions, respectively.

21. The combination cabinet and shelf structure according to claim 20 wherein said outer cabinet further comprises two laterally spaced, hollow support legs with said top surface extending therebetween, and further comprising a plurality of casters attached to said legs operable to roll said outer cabinet including said shelf over a substantially planar surface.

22. The combination cabinet and shelf structure according to claim 21 and further comprising first and second liftable casters attached to said platen and contacting said planar surface, said liftable casters including a lever pivotally connected to a block whereby moving said lever in a first direction operates to lift said liftable caster from said planar surface while simultaneously lowering said block to engage said planar surface, and whereby moving said lever in a second direction opposite said first direction operates to lift said block from said planar surface while simultaneously lowering said liftable caster to engage said planar surface.

23. The combination cabinet and shelf structure according to claim 22 wherein said vertical adjusting means further comprises a switch mounted to one of said legs and connected to said electric motor, said switch operable to selectively operate said motor between said first and second directions.

24. A combination cabinet and shelf structure comprising:

a) an outer cabinet having an open, forward side, a top, planar surface and means for supporting said top surface in a predetermined plane above and parallel to a substantially planar floor surface;

b) a shelf structure comprising:

i) a platen; and ii) a shelf mounted in superposed relation to said platen;

c) horizontal adjusting means connected to and between said outer cabinet and said platen, said horizontal adjusting means operable to horizontally move said platen including said shelf between a stored position with said platen and said shelf positioned beneath said outer cabinet top surface, and an extended position with said platen extending out of said outer cabinet open side and said shelf positioned entirely outside, forwardly of and adjacent to said outer cabinet;

d) power-driven, vertical adjusting means connected to and between said platen and said shelf, said vertical adjusting means operable to move said shelf throughout a vertical range of movement between a fully lowered position with said shelf in closely adjacent, covering relation to said platen, and a fully raised position with said shelf position above said predetermined plane, and to hold said shelf stationary in any desired vertical position throughout said range of movement, said shelf remaining in a plane parallel to said platen and said outer cabinet top surface throughout said vertical range of movement; and e) manually operable control means for actuation of said power-driven vertical adjusting means, said control means being mounted upon said outer cabinet and selectively actuable to cause said power-driven means to move said shelf upwardly and downwardly throughout said range of movement.

25. The structure of claim 24 wherein said vertical adjustment means includes structural members positioned between said cabinet top surface and said shelf when said shelf is in said fully raised position.

26. The structure of claim 24 and further including secondary support means adapted to position and support said platen above and parallel to said floor surface.

27. The structure of claim 26 wherein said secondary support means comprises at least one caster in rolling contact with said floor surface as said platen is moved between said stored and extended positions.

* * * * *